US005455749A

United States Patent [19]

Ferber

[11] Patent Number: 5,455,749

[45] Date of Patent: Oct. 3, 1995

[54] LIGHT, AUDIO AND CURRENT RELATED ASSEMBLIES, ATTACHMENTS AND DEVICES WITH CONDUCTIVE COMPOSITIONS

[76] Inventor: Andrew R. Ferber, 10 Waterside Plz., New York, N.Y. 10010

[21] Appl. No.: 229,359

[22] Filed: Apr. 18, 1994

Related U.S. Application Data

[63] Continuation-in-part of Ser. No. 69,196, May 28, 1993, abandoned.

[51] Int. Cl.[6] ..... F21L 15/08

[52] U.S. Cl. ..... 362/103; 362/252; 362/800; 362/806; 446/91

[58] Field of Search ..... 362/103, 104, 362/105, 106, 107, 108, 800, 252, 806, 807, 808, 809; 428/331, 901; 446/91; 252/500, 518; 40/550, 553

[56] References Cited

U.S. PATENT DOCUMENTS

| | | | |
|---|---|---|---|
| Re. 33,285 | 7/1990 | Kunen | 307/116 |
| 3,237,341 | 3/1966 | Janning | 446/91 |
| 3,517,937 | 6/1970 | Glass et al. | 273/157 |
| 4,052,256 | 10/1977 | Renaud et al. | 162/145 |
| 4,079,156 | 3/1978 | Youtsey et al. | 427/96 |
| 4,164,008 | 8/1979 | Miller et al. | 362/103 |
| 4,264,477 | 4/1981 | Seeger et al. | 252/503 |
| 4,480,293 | 10/1984 | Wells | 362/108 |
| 4,490,282 | 12/1984 | Corboy et al. | 252/503 |
| 4,499,010 | 2/1985 | Tanino et al. | 252/512 |
| 4,518,833 | 5/1985 | Watkins | 220/5 A |
| 4,529,539 | 7/1985 | Monma et al. | 252/518 |
| 4,570,206 | 2/1986 | Deutsch | 362/103 |
| 4,599,682 | 7/1986 | Stephens | 362/103 |
| 4,709,307 | 11/1987 | Branom | 362/103 |
| 4,727,603 | 3/1988 | Howard | 2/243 R |
| 4,823,240 | 4/1989 | Shenker | 362/103 |
| 4,839,777 | 6/1989 | Janko et al. | 362/108 |
| 4,869,701 | 9/1989 | Kawai et al. | 446/91 |
| 4,920,163 | 4/1990 | Guillaumon et al. | 523/440 |
| 5,006,278 | 4/1991 | Eisenbaumer | 427/385.5 |
| 5,066,422 | 11/1991 | Felter et al. | 252/511 |
| 5,104,583 | 4/1992 | Richardson | 252/518 |
| 5,113,325 | 5/1992 | Eisenbraun | 362/103 |
| 5,128,843 | 7/1992 | Guritz | 362/103 |
| 5,151,678 | 9/1992 | Veltri et al. | 340/321 |
| 5,176,853 | 1/1993 | Sarma et al. | 252/512 |
| 5,209,873 | 5/1993 | Yamamoto et al. | 428/901 X |

*Primary Examiner*—Stephen F. Husar

*Attorney, Agent, or Firm*—Lerner, David, Littenberg, Krumholz & Mentlik

[57] ABSTRACT

Generally improved current related assemblies, attachment and devices have at least one current operated module with means preferably for removably affixing said at least one current operated module in a predetermined position on apparel, objects and things, battery pack means to provide electrical power for operating said at least one current operated module, control means operatively associated with said battery pack means for controlling the operation of said at least one current operated module, and an improved and modified conductive composition including, a metallic mixture having silver and a plastisol to provide high conducting and low surface resistivity, printed, screened, painted, coated on or molded into said apparel, objects and things including, connecting means for removably connecting the deposited conductive composition to the at least one current operated module and to the battery pack means and the control means to establish a current and signal flow path therebetween. The modified conductive composition can be washed without damage thereto. An improved conductive composition as above described for the above assemblies, attachments and devices having a desired color to match designs, decorations and the like on the associated apparel, objects and things.

87 Claims, 5 Drawing Sheets

LIGHT, AUDIO AND CURRENT RELATED ASSEMBLIES, ATTACHMENTS AND DEVICES WITH CONDUCTIVE COMPOSITIONS

This application is a continuation-in-part of my application U.S. Ser. No. 08/069,196 filed May 28, 1993, now abandoned.

BACKGROUND OF THE INVENTION

This invention relates generally to light illuminating, light illuminating and sound, sound alone and other current related operating assemblies, attachments and devices for use in the actuation and activation of motors and other mechanical devices, on apparel, craft projects, toys, ceramic projects, customized gifts, point of purchase displays, advertising media and specialty applications, all generally referred to as apparel, objects and things and more particularly to light illuminating, light illuminating and sound, or sound alone assemblies, attachments and devices which include, conductive compositions suitably affixed to the interior or exterior of the apparel, objects and things so as to define either a current flow path or both a current flow path and a design and/or embodied in the design so as to provide the desired current flow path on such apparel, objects and things.

Conductive compositions when used herein are intended to mean electrically conductive liquids, inks, pastes and granules modified so they can be relatively easily painted, deposited, screened, coated or molded integrally with such apparel, objects and things, and dried or cured by various known techniques to become affixed thereto so as to function as part of a given assembly, attachment, kit or device.

Such electrically conductive compositions consist generally of a noble or base metal powder, carbon, graphite or other conductive particles or mixtures of the same, all combined in a suitable vehicle which contains a solvent and has a desired viscosity, and a resin which serves as a rheology control agent and a binder when the paste is cured or dried to maintain the conductive integrity of the conductive composition deposited on the apparel, objects and things. Such electrically conductive compositions may or may not include a colorant which can be a pigment or a dye.

The key difference between the conductive composition used in the attachments, assemblies, kits and devices in accordance with the present invention is that they can provide high conductivity at the voltage required in a variety of configurations as is more fully described below.

This is achieved by providing the conductive compositions with a high metallic composition including, silver and a plastisol based high conductivity compound. Such conductive composition may or may not include a colorant and are manufactured and marketed by Engelhard Corporation of East Newark, N.J. While colored conductive compositions are known where the conductive composition includes a colorant, they are more fully described in the Engelhard Corporation co-pending application U.S. Ser. No. 08/126,342 filed Sep. 24, 1993. This co-pending application is therefor incorporated by reference as part of the prior art background information.

Although conductive compositions have been used in signal circuitry in small mechanical devices which are mechanically connected to each other or in applications where high conductivity was not needed, such conductive compositions did not provide the high conductivity requirements needed in the power circuits for the attachments, assemblies, kits and devices in accordance with the present invention.

As for the known colored coating compositions, these are primarily compositions which are made either of conductive polymers which can be colored or use conductive particles which are colored or maintain the color inherent in the color of the particles in the composition such as the natural color of silver, aluminum, copper, bronze, gold and carbon black.

Thus, the final conductive composition whether colored or not painted, printed, screened, coated onto or molded integrally with the article, object or things will have a relatively high conductivity and low surface resistivity to both transmit the current requirements and the operating signals for each such attachment, assembly, kit or device because the LED or light or sound modules or other current actuated elements being operated require relatively low electrical power or current at the required voltage.

Various electrically conductive compositions, their physical characteristics and the means for achieving the desired conductivity and resistivity conditions are illustrated in the said co-pending application U.S. Ser. No. 08/126,342. While the illustrated embodiments in said application Ser. No. '342 are with respect to colored electrically conductive composition, those skilled in the art will readily recognize that the same physical, conductive and resistive characteristics can be achieved in conductive compositions which are not colored without departing from the scope of the present invention.

Usually such conductive compositions whether colored or not are in an organic system, but aqueous systems are also possible. They can be applied by forming the conductive composition into some form of film, liquid or paste and then printing, depositing, screening, painting, coating or molding the conductive composition onto or integrally with the substrate defining the apparel, objects and things followed with the step of drying and/or curing the conductive composition so applied to affix it in or on such apparel, objects and things.

In the present invention there are many different ways of applying and activating the conductive compositions which may be applied to different materials such as fabric, plastic, wood, paper, cardboard and rubber as may be required for the given application.

These include:

1. painting, depositing, screening or coating the conductive composition directly on the exterior or interior of the particular substrate either independently of or as part of the particular design,
2. painting, depositing, screening or coating the conductive material directly on the exterior and then layering over the conductive material with the design, the underlayer providing the conductive current path, and the covering layer the design of nonconducting material so that the light illuminating and/or sound units can be brought into contact with the underlayer of conductive composition,
3. painting, depositing, screening or coating the conductive material on the inner surface, for example, a panel of fabric or other material, forming the design on the exterior of the fabric or other material so that the light illuminating or sound devices can be connected through the particular material to the associated conductive material, and
4. forming by molding or otherwise the conductive material either as part of plastic material such as in the form of stripes or on the surface of the particular plastic material so the light illuminating or sound devices can be connected thereto to provide the desired circuitry.

Thus the conductive compositions in the present invention have a wide and extensive usage depending on the application because the conductive composition can be applied independently or as part of the design where matching colors that are the same as the associated design are needed and the light illuminating, sound devices or other current operated attachments can be easily connected into assembled and functioning positions.

One type of application for which the present application is particularly suited is to replace the known type of modern light illuminating, light illuminating and sound and/or sound alone assemblies, attachments, kits and devices generally characterized by at least the following elements, first a plurality of light emitting diode (LED) modules and/or sound modules, means for affixing, generally removably affixing, the LED modules and/or sound modules into assembled position, battery pack means to provide electrical power for illuminating said LED modules and/or operating the sound modules, control module means operatively associated with said battery pack means for controlling the operation of the LED and/or the sound modules, and physical, hard wire and the like current conducting connecting lines for independently connecting each or several of said LED and/or sound modules to said battery pack and operatively associated control means.

Such light illuminating, light illuminating and sound and sound alone assemblies, attachments, kits and devices are well known in the commercial marketplace, and there are a multitude of prior art patents which show and describe various such devices for use on apparel, objects and things for a corresponding wide variety of purposes as, for example, U.S. Pat. Nos. 4,823,240; 4,709,307; 4,599,682; 4,570,206; 4,839,777; and 5,113,325.

All of these forms of assemblies, attachments, kits and devices required disassembly of some or all of the elements and parts in order, for example, to clean apparel on which they were mounted or to modify the connection in the system. Further, all of these prior art attachments, assemblies, kits and devices are characterized by the use of some form of hard wire conductor, flexible circuit boards, flexible current conducting tapes which served as the current conducting means between the LED modules and/or sound modules and the battery pack and the control means for supplying current and signals.

The present invention improves and advances over all of the commercially known and the prior art patented attachments, assemblies, kits and devices by providing a substantially simple and cheap current conducting means in the form of a conductive composition either colored or not modified to provide the necessary high conductivity and low resistivity characteristics, and means for connecting and delivering current and signals to the LED and/or sound modules from the battery pack and the control means.

Thus the improved attachments, assemblies, kits and devices in accordance with the present invention require means for connecting the LED and/or sound modules to one end of the electrically conductive composition painted, deposited, screened, coated or molded integrally with the substrate defining the apparel, objects and things and provides a removable connection at the opposite end so that the battery pack and the control means operatively associated with the LED and/or sound modules can be easily separated from the assembly.

Optionally the LED and/or sound modules can be removably connected to the substrate defining the apparel, objects and things to further facilitate disassembly of the improved attachment, assemblies, kits and devices in accordance with the present invention.

Using the electrically conductive composition provides an improved attachment, assembly, kit or device and meets and overcomes the problems associated with the disassembly of the light illuminating, light illuminating and sound, and sound alone attachments, assemblies, kits and devices for the purpose of cleaning the associated apparel on which such attachments, assemblies, kits and devices are used. Further, however, it provides greater facility and flexibility in the uses and applications of light illuminating, light illuminating and sound or sound alone attachments, assemblies, kits and devices, for example, to toys, jigsaw puzzles, warning signals, advertisements, operation of motors and other mechanical things, etc., as is more fully described and illustrated herein.

The use of colored conductive coating compositions in such attachments, assemblies, kits and devices has particular significance from a commercial standpoint because it enables the manufacturers of various devices, assemblies, kits, toys, pop-up books and the like to be easily and cheaply designed, manufactured and sold into the commercial marketplace.

SUMMARY AND OBJECTS OF THE INVENTION

Thus the present invention provides generally improved attachments, assemblies, kits and devices having at least one current operated module with means for affixing said current operated module in a predetermined position on apparel, objects and things, battery pack means to provide electrical power for operating said at least one current operated module, control means operatively associated with said battery pack means for controlling the operation of said at least one current operated module, and electrically conductive means including, conductive composition means with or without colorant affixed to the apparel, objects and things for communication with the at least one current operated module and connecting means remote from the current operated modules for removably connecting the conductive composition means to the battery pack means and the control means.

Further objects and advantages and a better understanding of the present invention will become apparent from the detailed description which follows taken in connection with the accompanying drawings in which:

DESCRIPTION OF ONE EMBODIMENT

Referring to FIGS. 1 to 4 of the drawings, one form of an attachment in accordance with the present invention shows a garment in the form of a sweatshirt generally designated 10 having a decoration 11 of a Christmas tree on the outer surface of the front panel 12 which is generally screened or otherwise printed thereon. Garments with these and other decorations are available in the commercial marketplace and hence do not have to be more fully described.

Those skilled in the art will readily understand that while a sweatshirt is illustrated, this and such other forms of the attachments, assemblies, kits and devices in accordance with the present invention can be applied to any piece of apparel or to various forms of fabric and the like materials without departing from the scope of the invention.

Figure 1:
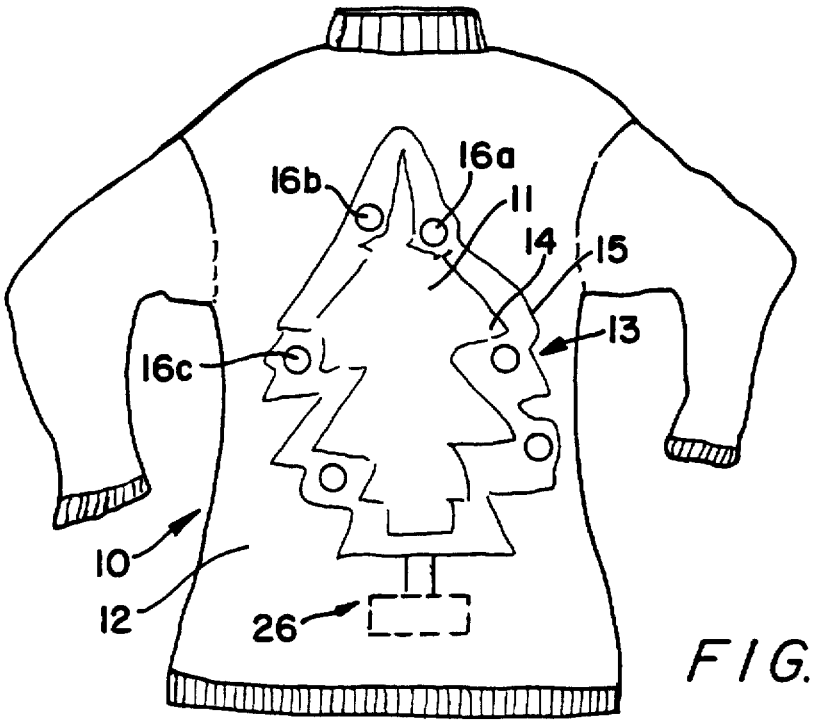
FIG. 1 is a diagrammatic sketch of an article of clothing having affixed thereto one form of light illuminating assembly in accordance with the present invention in which the conductive composition is affixed to the exterior of the garment in operative association with the design, decoration, slogan, etc. also on the exterior of the garment.
Figure 3:
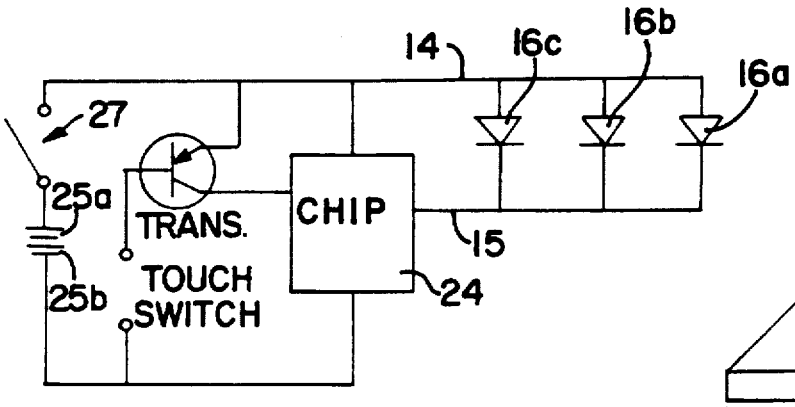
FIG. 3 is a schematic diagram for the current carrying circuit for the light illuminating assembly shown in FIGS. 1 and 2 of the drawings.
Figure 2:
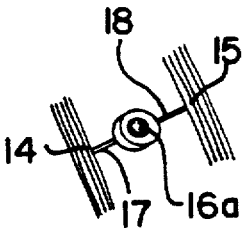
FIG. 2 is a diagrammatic sketch showing how one of the LED modules are connected across the conductive composition stripes of the light illuminating assembly shown in FIG. 1.

In the attachment, assembly or device generally designated 13 in accordance with the present invention, the improved conductive composition in the form of two spaced lines as at 14 and 15 are printed, painted, deposited, screened or coated on the outer surface of the front panel 12 about the periphery of the Christmas tree decoration 11 so that a plurality of randomly spaced LED modules **16*a*, 16*b*, 16*c*, etc. can be connected by their respective current conducting connecting lines, for example, lines 17 and 18 for the LED module 16*a*, across the conductive composition lines 14 and 15, all of which is clearly shown in FIGS. 1, 2 and 3** of the drawings.

The ends 19 and 20 of the conductive composition lines 14 and 15 remote from the positions where the various LED or sound modules **16*a*, 16*b*, 16*c*, etc. are connected to the exterior of the sweatshirt 10, are detachably connected by any suitable means such as male plug-in connectors 21 and 22 to female connectors, not shown, on a printed circuit board generally shown at 23 having an IC chip 24 which is operatively connected to a suitable electrical power source such as batteries 25*a* and 25*b***.

Figure 4:
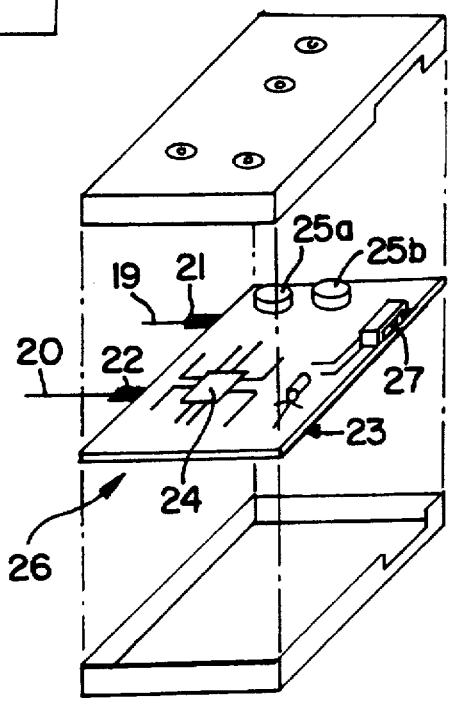
FIG. 4 is an exploded view of one form of composite battery pack and control member and the operative connection thereto of one end of the respective conductive composition stripes for the assembly shown in FIG. 1 of the drawings.

The printed circuit board 23 is part of the composite battery pack and control member generally designated 26 and shown in exploded form at FIG. 4. The composite battery pack and control member 26 also include other elements such as an on-off switch 27 for placing the attachment, assembly, kit or device into operation for delivering power and operating signals to the LED modules as at **16*a*, 16*b*, 16*c*, etc. and/or sound modules which can also be added to the circuit by connecting them across the conductive composition stripes 14 and 15 in the same manner as above described for the LED modules and as shown at FIG. 2** of the drawings.

The electrical circuit for this attachment, assembly, kit or device in accordance with the present invention is illustrated at FIG. 3 and like numbers corresponding to the parts as above described are also shown in this FIG. 3.

DESCRIPTION OF ANOTHER EMBODIMENT

Figure 5:
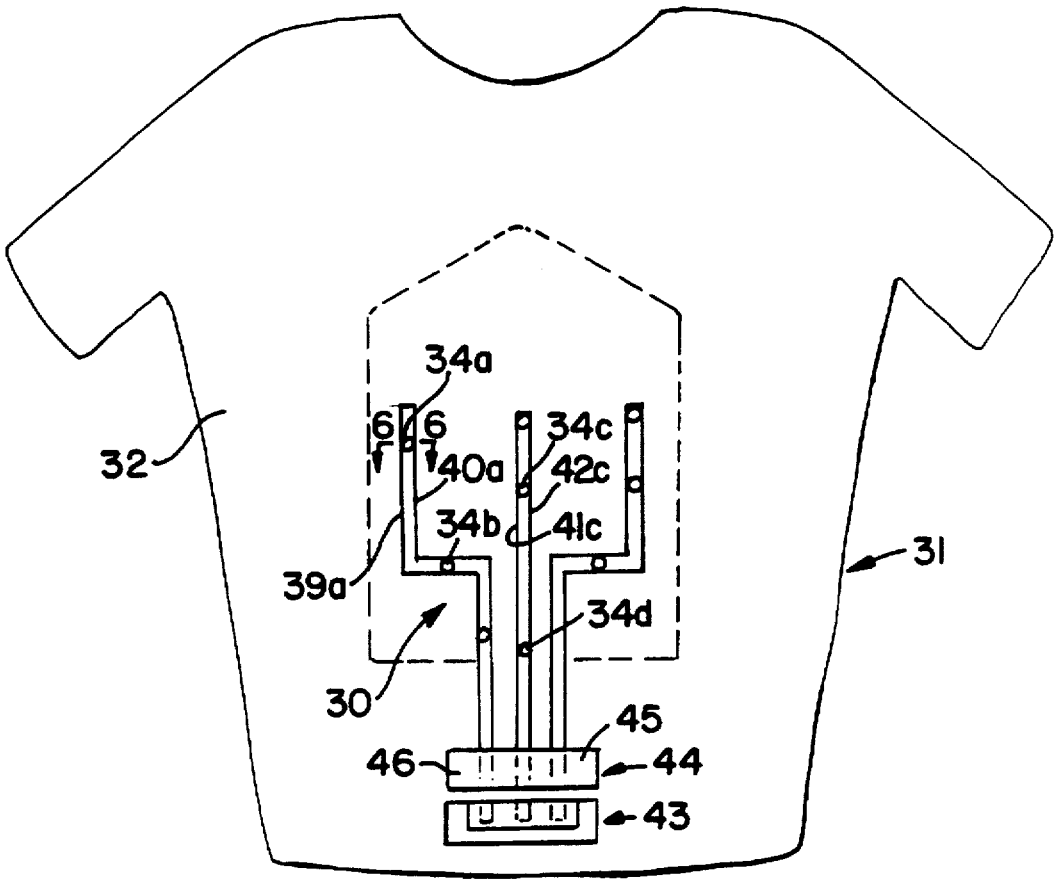
FIG. 5 is a diagrammatic sketch of an article of clothing having affixed thereto another form of light illuminating assembly in accordance with the present invention in which the conductive composition is affixed to the interior of the garment to enable the LED or sound modules of the assembly to be disposed for operative association with the design, decoration, slogan, etc., disposed on the exterior of the garment.

Referring further to the drawings, FIGS. 3, 4 and 5 illustrate another form of assembly, attachment, kit or device generally designated 30 in accordance with the present invention also as applied for use on apparel, such as a sweatshirt 31. In this form of the invention the conductive composition is coated on the interior surface of the garment, and the LED and/or sound modules are connected to the conductive composition and extend to the exterior of the garment as will now be more fully described, Thus, sweatshirt 31 has a panel 32. On the outer surface, not shown, the panel will have a design, decoration, slogan, name, etc. which is generally indicated by the dotted lines 33. Such designs, decorations, etc. can be printed, screened, painted or hot stamped on the outer face of the panel. Sweatshirts bearing such decorations, designs, slogans, etc. as indicated in the first form of the invention above described are well known in the commercial marketplace and accordingly will not be more fully illustrated or described.

In accordance with the general concept and uses of light illuminating, light illuminating and/or sound assemblies, kits or devices, the light illuminating, light illuminating and/or sound or sound alone attachment or assembly, kit or device 30 is affixed or attached to the inner surface of panel 32 and so assembled thereon as is hereinafter described to illuminate or be otherwise operatively associated with the design, decoration, etc. 33 on the outer surface of the panel 32.

Thus, the attachment, assembly, kit or device 30 as illustrated includes, a plurality of LED modules 34*a*, 34*b*, 34*c* and 34*d*, etc. which extend through a corresponding plurality of slits or openings in panel 32, only one of which is illustrated as at 35*a* in the FIG. 2 cross-section of the drawings for LED module 34*a*.

In FIG. 2 one form for removably affixing the LED module into assembled position is shown as including, an LED module threaded about the exterior adjacent the lower end as at 36*a* so that when the LED module is extended through the slit or opening 35*a* in the panel 32, a matching threaded element 37*a* can be removably threaded on the LED module 34*a* to hold the same in assembled position and permit the easy removal thereof for any purpose. The removable connecting means illustrated at FIG. 2 is the subject matter of and is shown and described more fully in co-pending application U.S. Ser. No. 08/004,718 filed Jan. 14, 1993, now U.S. Pat. No. 5,278,734.

The LED modules 34*a*, 34*b*, 34*c*, 34*d*, etc. have there respective current conducting lines as, for example, at 38*a* and 39*a* for the LED module 34*a* shown in FIG. 2, connected by any suitable means to conductive composition lines painted, printed, screened or coated onto the inner surface of panel 32 in two striped lines as at 39*a* and 40*a* for LED modules 34*a* and 34*b* and 41*c* and 42*c* for LED modules 34*c* and 34*d*. While the LED modules illustrated are connected in groups of two LED modules to their associated conductive composition striped lines, those skilled in the art will readily recognize that this is solely for illustration purposes and that there could be one or more LED modules and/or sound modules on a given pair of conductive composition stripes without departing from the scope of the present invention.

In this regard it is known in the art that individual LED modules can be separately connected to hard wire or the like type current conducting lines in order to give the LED modules greater freedom of movement for illuminating the design, decoration, slogan, etc. on the front panel of the sweatshirt or other garment.

Such structure is rendered unnecessary by the use of the modified conductive composition means in accordance with the present invention because the modified conductive composition is affixed to the inner or outer face of the fabric forming the panel 32 and is washable therewith, and the positioning or repositioning of the LED or sound modules can be easily accomplished with respect to the modified conductive composition.

The respective conductive composition stripes 39*a*, 40*a*, 41*c* and 42*c* forming the current and signal flow path on the inner surface of the panel 32, at the end remote from or spaced from the sections connected to the LED modules 34*a*, 34*b*, 34*c*, 34*d*, etc., communicate with a composite battery pack and control member 43 through a removable or detachable connector generally designated 44 in such a way that the battery pack and control member 43 can be removed and replaced from assembled position on the inner surface of the panel 32. Thus, when it is necessary or desirable to clean the sweatshirt, not only can the LED modules be removed and replaced but also the combined battery pack and control unit can also be removed and replaced with relative ease. However, because of the characteristics of the modified conductive composition, the garment or apparel on which it is printed, screened or coated can be washed without damage to the conductive composition means thereon.

In the present illustrated form of the invention, the removable and detachable connector 44 consists of a VELCRO® fastener which is not only used for this purpose but also is treated to make it conductive for operative association with the conductive composition stripes to provide the operative communication between the LED modules 34*a*, 34*b*, 34*c*, 34*d*, etc. with the battery pack which supplies the current and power for operating the LED modules and the control means which supplies the electronic signals for operating the LED modules.

VELCRO® fasteners are known in the art, but the VELCRO® fastener which serves as the removable and detachable connector 44 must be modified by adding the conductive composition for the present illustrated form of light illuminating assembly, kit or device. Thus, the first VELCRO® member 45 of the modified VELCRO® fastener defining the removable and detachable connector 44 is painted or coated with conductive composition and affixed to the inner surface of panel 32 such as by epoxy or sewing the same in assembled position so that the respective conductive composition stripes 39*a*, 40*a*, 41*c* and 42*c*, etc. can in turn be brought into conductive communication with the first VELCRO® member 45 by any suitable means such as overlapping, abutment or adhering the same to the conductive composition stripes 39*a*, 40*a*, 41*c*, 42*c*, etc., all of which is clearly shown in FIGS. 5 and 7 of the drawings.

The associated second VELCRO® member 46 serves two purposes. First, it is also modified by painting or coating with the conductive composition so as to provide communication with the electrical power source and electronic signals provided by the combined battery pack and control 43 but in assembled position communicates with the conductive composition on the first VELCRO® member 45 to enable the current and control signals from the combined battery pack and control 43 to be transmitted and transferred through the conductive composition stripes 39*a*, 40*a*, 41*c* and 42*c*, etc. to the LED modules. Second, the modified VELCRO® fastener which defines the removable and detachable connector 44 provides for a simple removable connecting means for the combined battery pack and control 43 so it can be removed and replaced as may be necessary or desirable for any reason.

Figure 6:
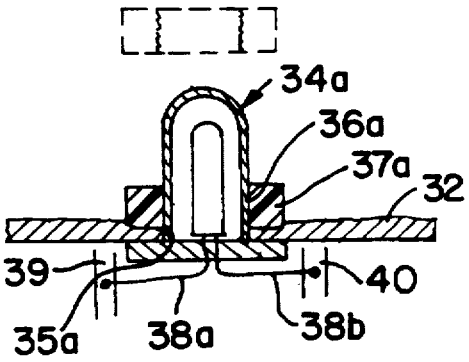
FIG. 6 is an enlarged cross-section taken on line 6—6 of FIG. 5 showing one means for removably connecting the LED module in assembled position on the front panel of the article of clothing shown in FIG. 4.
Figure 7:
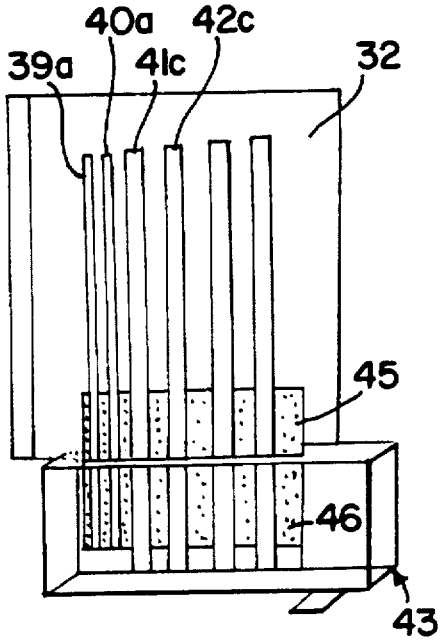
FIG. 7 is an enlarged view of the removable connection shown in FIG. 5 between the conductive composition printed, painted, screened or coated on the interior of the apparel and the battery pack and control means for supplying current and for operating the LED modules.

While this embodiment of the invention is illustrated for a piece of apparel, those skilled in the art will readily recognize that the light illuminating assembly, kit or device illustrated in FIGS. 5, 6 and 7 can be applied to any type of apparel, fabrics, wearable and non-wearable clothing such as T-shirts, safety uniforms, natural or man-made material, and to objects and things such as hats, umbrellas, shoes, goggles or glasses, headbands, armbands, knapsacks, drinking glasses and other vessels.

Further, while a light illuminating attachment, assembly, kit or device has been illustrated that a light illuminating and/or sound, or sound alone attachment, assembly, kit or device can also be used without departing from the scope of the present invention. Such variations are adapted to provide a corresponding myriad of applications, for example, to identify slogans, for advertising purposes and for safety and health purposes.

A light illuminating assembly, kit or device in accordance with the present invention, because of the use of the conductive composition stripes as the element for carrying the electrical current and control signals between the battery pack and the LED and/or sound module, can be easily adapted for use on games or toys as is illustrated in FIGS. 8 to 15 now to be described.

DESCRIPTION OF ANOTHER EMBODIMENT

Figure 8:
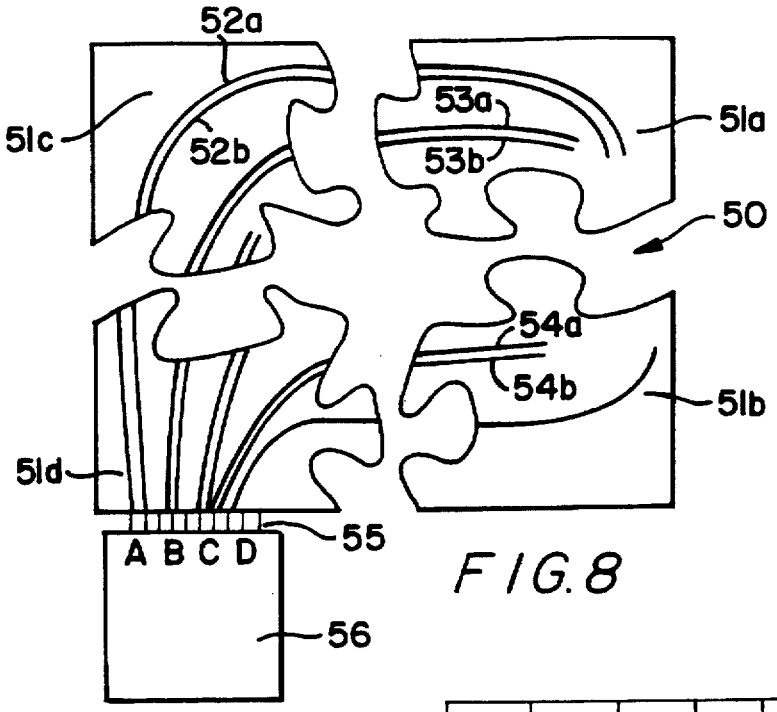
FIG. 8 is a plan view of a disassembled jigsaw puzzle having the conductive composition painted across the various pieces of the jigsaw puzzle and interconnected to a composite battery pack and control module to provide an assembly in accordance with the present invention.
Figure 11:
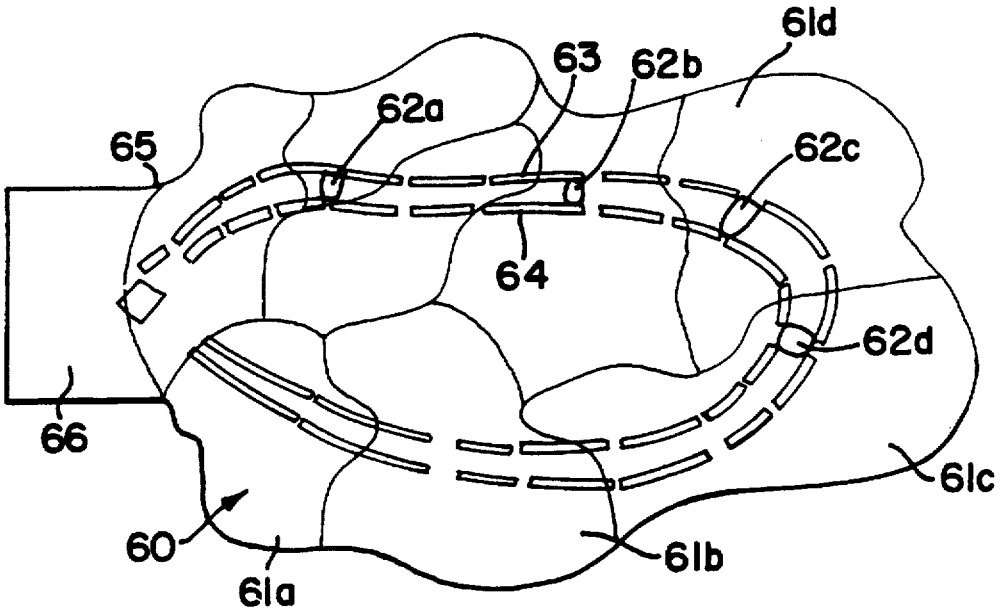
FIG. 11 is a plan view of a jigsaw puzzle with a light illuminating assembly in accordance with the present invention affixed to pieces and parts of the puzzle so that the LED modules are disposed in series with the current and control sources for the light illuminating assembly.
Figure 12:
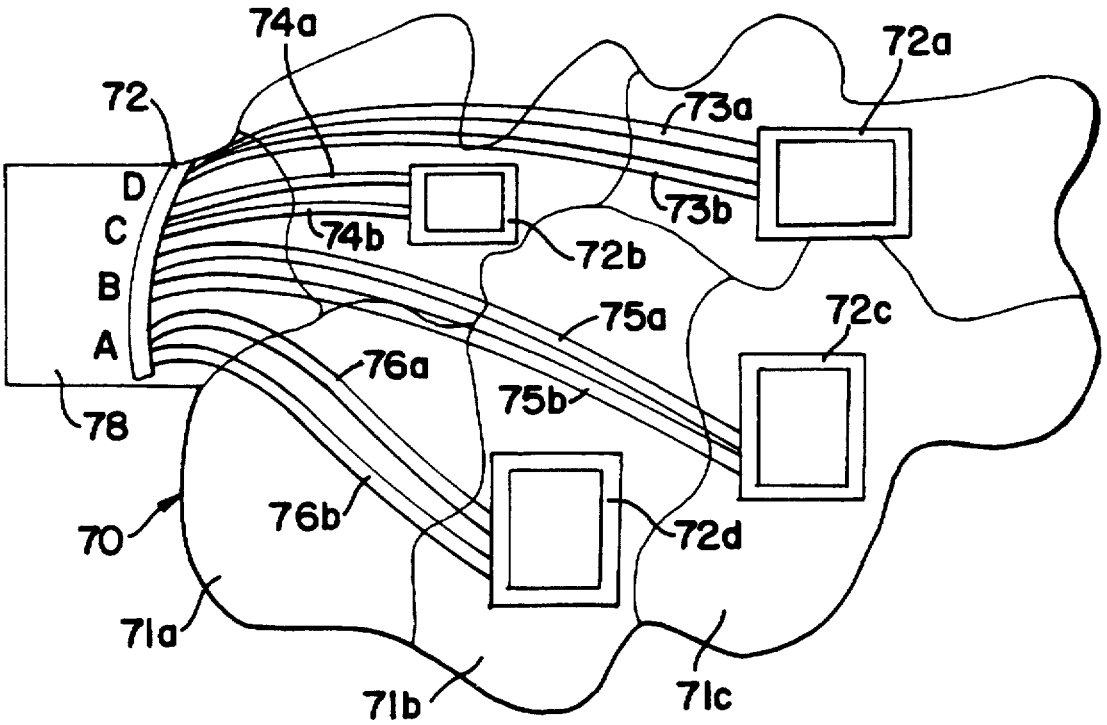
FIG. 12 is a plan view of another jigsaw puzzle with a light illuminating assembly in accordance with the present invention affixed so that individual sound modules are associated with pieces of the jigsaw puzzle and are independently connected in parallel respectively to the current and control sources so they can be separately operated.

FIG. 8 shows a light illuminating and or sound device attachment, assembly or device in accordance with the present invention as applied to a jigsaw puzzle generally designated 50 having a plurality of associated and interconnecting pieces as at 51*a*, 51*b*, 51*c*, 51*d*, etc. by which the jigsaw puzzle is established when in use, and on which the conductive composition is painted, deposited, screened or coated as a plurality of pairs of current conducting stripes as at 52*a* and 52*b*; 53*a* and 53*b*; 54*a* and 54*b*, etc. on the back surface of the associated interconnecting pieces of the jigsaw puzzle so that either a plurality of LED modules, LED and sound modules or sound modules, not shown in FIG. 8 but illustrated in FIGS. 11 and 12 to be described, can be connected across the conductive composition stripes 52*a* and 52*b*; 53*a* and 53*b*; and 54*a* and 54*b*.

While reference has been made to painting or coating the conductive composition on the back surface of the pieces of the jigsaw puzzle, it is also possible to use either a colored conductive composition and/or a colorless conductive composition so that the conductive composition stripes 52*a*, 52*b*, 53*a*, 53*b*, 54*a*, 54*b*, etc. can be printed, painted, screened, deposited or coated on the front or outer surface of the pieces 51*a*, 51*b*, 51*c*, 51*d*, etc. of the jigsaw puzzle.

The conductive paint will communicate at one end through a suitable releasable connector member generally designated 55 to a composite battery pack and control member 56, such as the same type of VELCRO® fastener as above described for the form of the invention as shown in FIGS. 5, 6 and 7.

This combination of elements for a light illuminating assembly, kit or device in accordance with the present invention allows for a wide variety of operative arrangements to be associated with the assembly of the pieces of the jigsaw puzzle. It also permits the introduction of musical or other sound attachments, not shown, which can also be connected in series or parallel to the conductive paint stripes.

DESCRIPTION OF ANOTHER EMBODIMENT

FIG. 11 illustrates a jigsaw puzzle generally designated 60 after the pieces 61*a*, 61*b*, 61*c*, 61*d*, etc. have been fully assembled with a light illuminating assembly, kit or device in accordance with the present invention thereon in which the LED modules 62*a*, 62*b*, 62*c*, 62*d*, etc. are connected in series on the associated conductive composition stripes 63 and 64 disposed on the back surface of the respective pieces 61*a*, 61*b*, 61*c*, 61*d*, etc. for the given jigsaw puzzle.

The conductive composition stripes 63 and 64 communicate at the end remote from the point of attachment of the respective LED modules is connected by a suitable releasable connector generally designated 65 to the composite battery pack and control member generally designated 66 so that the operating current and signals can be transmitted through the conductive composition stripes 63 and 64 to the LED modules 62*a*, 62*b*, 62*c*, 62*d*, etc.

Figure 9:
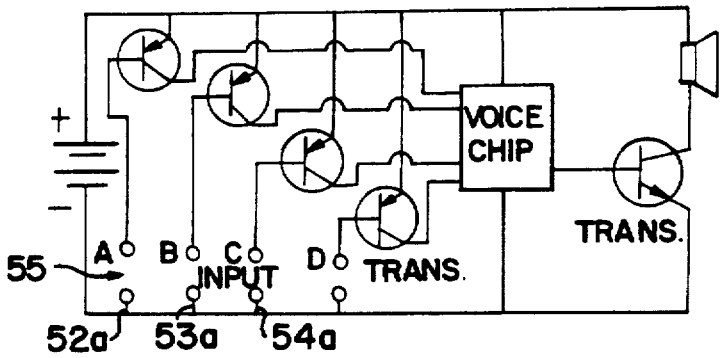
FIG. 9 is a schematic diagram of the current carrying circuit for the assembly on the jigsaw puzzle shown in FIG. 8.
Figure 10:
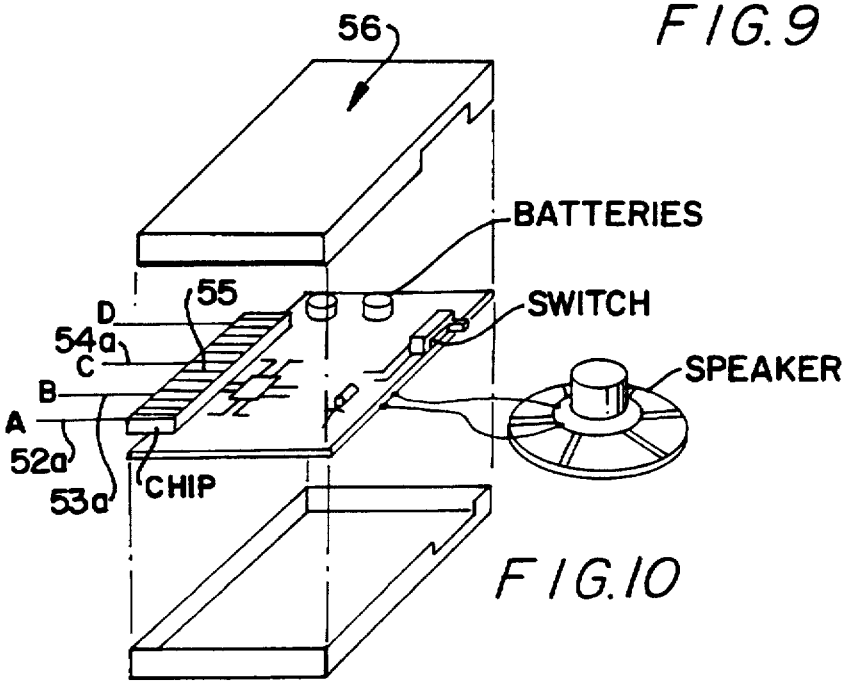
FIG. 10 is an exploded view of the composite battery pack and control member for the assembly on the jigsaw puzzle shown in FIG. 8.

One form of composite battery pack and control member is shown at FIG. 10 of the drawings, and the circuitry therefor is shown at FIG. 9 of the drawings. Such composite battery pack and control members and the circuitry associated therewith are available on the open market and accordingly are not more fully described as they will be easily understood by those skilled in the art.

DESCRIPTION OF ANOTHER EMBODIMENT

FIG. 12 shows the use of another attachment, assembly, kit or device in accordance with the present invention for use on a jigsaw puzzle which differs from the form of the invention as illustrated in FIG. 11 in that the assembly uses sound modules which are independently connected by parallel conductive composition stripes to the composite battery pack and control member.

Thus, referring to FIG. 12 the jigsaw puzzle generally designated 70 consists of a plurality of associated and interconnected jigsaw puzzle pieces as at 71*a*, 71*b*, 71*c*, etc. which have been fitted together to provide the finished jigsaw puzzle 70. Spaced on various of the associated and interconnected pieces 71*a*, 71*b* and 71*c*, etc. of the jigsaw puzzle 70 are sound modules diagrammatically illustrated as at 72*a*, 72*b*, 72*c* and 72*d* so that when the said pieces of the jigsaw puzzle 70 are assembled, the respective sound modules will in turn be electrically connected to operatively associated pairs of conductive paint stripes as at 73*a* and 73*b* for sound module 72*a*; 74*a* and 74*b* for sound module 72*b*; 75*a* and 75*b* for sound module 72*c*; and 76*a* and 76*b* for sound module 72*d*. Each of these respective pairs of conductive paint stripes at the end of the respective pairs of paint stripes remote from the end connected to its associated sound module will in turn be connected to a suitable releasable connecting assembly generally designated 77; such as by a VELCRO® connector as above described for the form of the invention shown in FIGS. 5, 6 and 7. However, in this form of the invention, the respective sound module 72*a*, 72*b*, 72*c* and 72*d* can represent four different sounds; for example, a cat, a horn, etc. when the sound is touched. In order to accomplish this, the respective conductive composition stripes 73*a*, 73*b*, 74*a*, 74*b*, 75*a*, 75*b*, 76*a* and 76*b* represented by the character numerals A, B, C and D are connected by any suitable male plug means, not shown, which fits into a female plug assembly, as at 55 on the composite battery pack and control member 56 shown in FIG. 10 of the drawing, and at the circuity therefore as shown at FIG. 11. The composite battery pack and control member 78 is substantially identical to that shown by the circuity and exploded view at FIGS. 9 and 10.

In this form of the attachment, assembly, kit or device in accordance with the present invention, the sound modules and their associated pairs of conductive paint stripes are independently connected to the composite battery pack and control member 78, hence the desired operation for the sound modules 72*a*, 72*b*, 72*c* and 72*d* will become a function of the setting in the control member chip of the composite battery pack and control member 78.

As in the earlier forms of the present invention above described, one type of composite battery pack and control member is shown at FIG. 10. These devices are known as are the electronic chips which provide the desire forms of operation and are available in the commercial marketplace. Accordingly these composite units as shown herein have not been more fully described because they will be understood by those skilled in the art.

DESCRIPTION OF STILL ANOTHER EMBODIMENT

To demonstrate the versatility of the present invention, still another form of light illuminating assembly, kit or device is shown at FIGS. 13, 14, 15 and 16 as being used in conjunction or in combination with toys such as an erector set, building blocks, etc.

Figure 13:
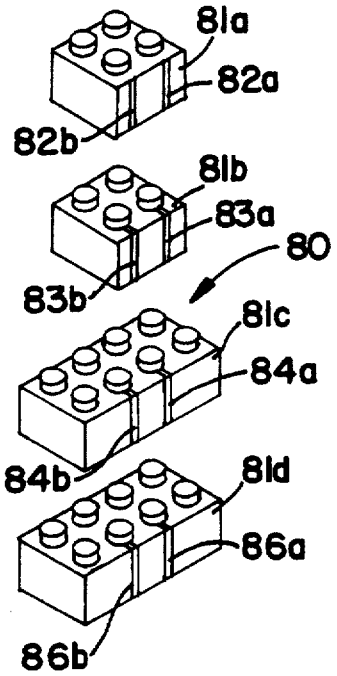
FIG. 13 is an exploded perspective front view of children's toy blocks having a light illuminating assembly in accordance with the present invention affixed thereon and showing the composite battery pack and control member connected to the conductive composition formed on the various toy blocks.
Figure 14:
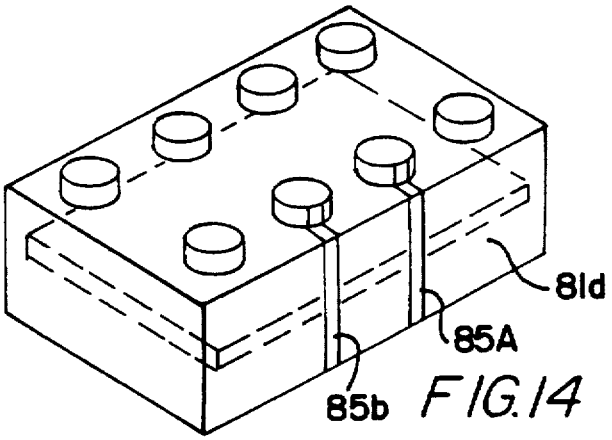
FIG. 14 is a perspective side view of one of the toy blocks shown in FIG. 13 showing the conductive paint thereon and the associated composite battery pack and control member mounted in the illustrated block.
Figure 15:
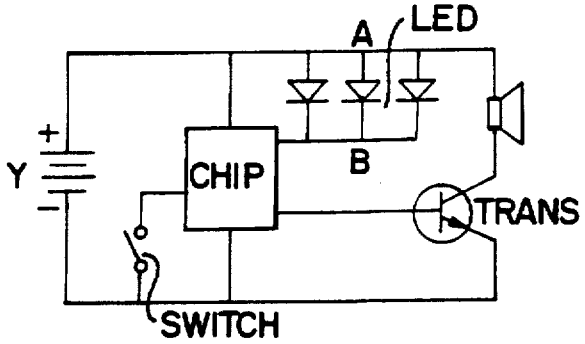
FIG. 15 is a schematic diagram of the current carrying circuit for the light illuminating assembly in accordance with the present invention as shown in FIG. 13.

Thus, referring to FIGS. 13 and 14 one type of well known children's building blocks generally designated 80 is shown having a plurality of building block pieces as at 81*a*, 81*b*, 81*c* and 81*d*, which are made so that when the blocks are interconnected one with the other, they can form, for example, the column as diagrammatically illustrated in FIG. 13.

Toys, games and other devices such as these are available in the commercial marketplace as, for example, erector sets, LEGO® building block sets, etc. All of these sets, toys, games and other devices are characterized by associated and interconnected parts by which buildings, mechanical devices and other shapes, designs and forms may be formulated.

The present invention is particularly adapted for application to these toys, games and other devices with associated and interconnected parts because the conductive paint stripes for transmitting the current and power for illuminating any LED modules and/or operating audio devices as well as the electronic signals for operating such LED modules and/or audio devices can be easily applied to the associated and interconnected parts as by painting, coating, printing, screening or molding integrally with the blocks so that when the parts are together, an electrically and electronic line for current and other signals is established.

The high conductivity of the conductive compositions is ideally suited for such mechanically interconnected parts first because it can be deposited on the interchangeable or interconnected parts in such a number of different ways, and second because the conductive composition when so painted, printed, screened, coated on the interconnecting parts or molded integrally therewith provides a relatively low circuit resistance without impairing the high conductivity of the conductive composition.

Thus, in FIGS. 13 and 14 the conductive paint stripes are shown as at 82*a* and 82*b* for building block piece 81*a*, 83*a* and 83*b* for building block piece 81*b*, 84*a* and 84*b* for building block piece 81*c*, and 85*a* and 85*b* for building block piece 81*d*. Each of the conductive paint stripes 82*a*, 82*b*, 83*a*, 83*b*, 84*a*, 84*b*, 85*a* and 85*b* will be so affixed to the building blocks or molded into the building blocks that they will be in conductive contact with each other when the building blocks 81*a*, 81*b*, 81*c* and 81*d* are assembled together.

Further, as shown in FIGS. 13 and 14, conductive composition stripes can also be painted, printed, coated, screened or molded so they will provide a current and signal flow path on the inside of the building block piece as at 86*a* and 86*b* for building block piece 81*a* or 81*d*. Connecting conductive paint stripes across the bottom of the building block piece as at 86*a* and 86*b* can thus be provided so that the LED module 87 which is affixed or removably connected in the side of the building block 81*a* or 81*d* can have its electrical conducting lines as at 82*a* and 82*b* connected to the respective connecting conductive composition stripes on the interconnected building blocks for communication with the associated and interconnected conducting composition stripes 82*a*, 82*b*, 83*a*, 83*b*, 84*a*, 84*b*, 85*a* and 85*b* for the building block pieces 81*b*, 81*c* and 81*d*.

The composite battery pack and control member can be mounted in one of the associated and interconnected building block pieces, as indicated by the dotted lines for building block 81*d*, and any suitable type of connector assembly for connecting the composite battery pack and control member to the conductive composition stripes will provide means for transmitting the current and signals from the composite battery and control member to said conductive composition stripes and the associated LED modules and/or audio devices.

DESCRIPTION OF A STILL FURTHER EMBODIMENT OF THE INVENTION

The modified conductive composition is adapted to provide a still further attachment, assembly, kit or device in accordance with the present invention in which the LED and/or sound modules can be touch activated by the wearer of the garment or apparel on which the attachment, assembly, kit or device is mounted.

Figure 16:
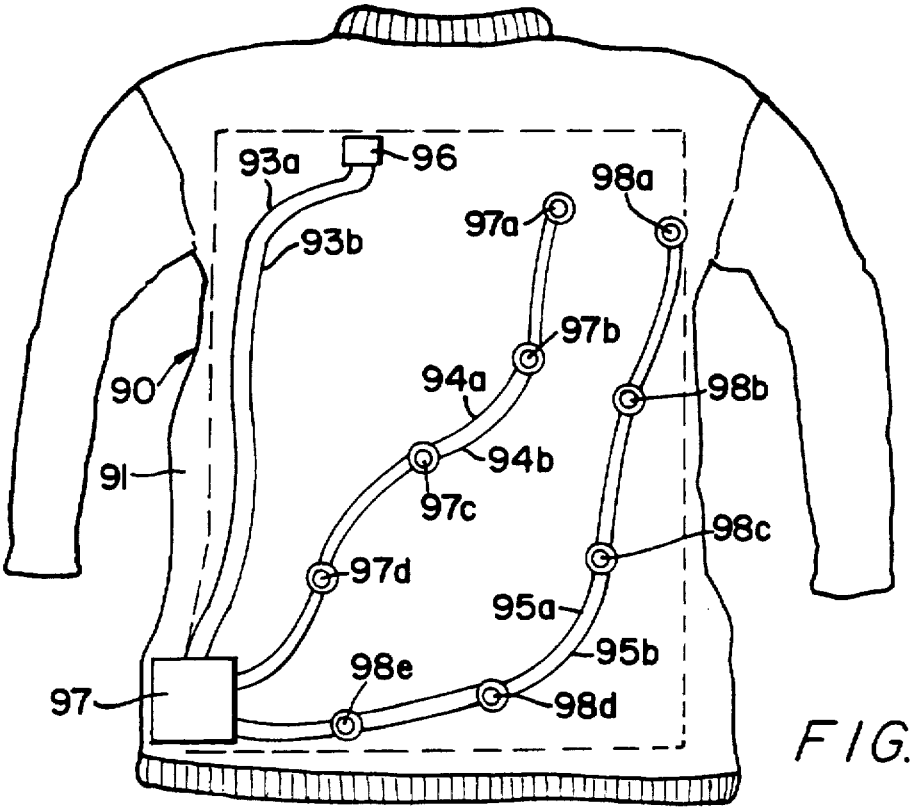
FIG. 16 is a diagrammatic front view of a sweatshirt having still another form of the present invention thereon in which the conductive composition materials are so affixed that they are incorporated into the fabric of the sweatshirt and enable merely touch activation of the attachment, assembly, kit or device connected to the garment or apparel.

Thus, by reference to FIG. 16 of the drawings, a sweatshirt generally designated 90 is shown having a panel 92 with a design decoration, slogan, etc. generally designated 92 as shown by the dotted lines thereon which is a common article of commerce.

Integrally affixed in any manner as above described into the fabric of the sweatshirt 90 is the modified conductive composition material as indicated by the stripes 93*a* and 93*b*; 94*a* and 94*b*; and 95*a* and 95*b*.

The conductive composition stripes 93*a* and 93*b* communicate at one end with a switch means 96 and at the end remote therefrom with a composite battery pack and control member 97 so that when the switch 96 is touched by the wearer of the sweatshirt, the composite battery pack and control member 97 is activated to deliver current and operating signals to the associate conductive composition stripes 94*a*, 94*b*, 95*a* and 95*b* so that randomly connected LED modules as at 97*a*, 97*b*, 97*c* and 97*d* connected to the conductive composition stripes 94*a* and 95*b*; and the randomly connected sound modules as at 98*a*, 98*b*, 98*c*, 98*d* and 98*e* will be activated and operated.

The composite battery pack and control module 97 and the switch 96 and spaced LED modules 97*a*, 97*b*, 97*c* and 97*d* and 98*a*, 98*b*, 98*c*, 98*d* and 98*e* are all connected so as to facilitate the operation by touch control of this type of attachment.

While the foregoing description illustrates various preferred embodiments of apparatus and systems in accordance with the present invention, it will be appreciated that certain changes and modifications may be made in the structure of these disclosed arrangements without departing from the spirit and scope of the invention and that the same is defined by the claims as hereinafter set forth.

What is claimed is:

1. An electrical system for forming a design on an object, said electrical system comprising, at least one current operated module having means for affixing the module in a predetermined position on said object, battery pack means to provide the current for operating said at least one current operated module, and conductive composition means connecting said battery pack means to said at least one current operated module for delivering current to operate said current operated module, said conductive composition means forming at least a portion of said design.

2. In the electrical system of claim 1 including, means for detachably connecting said conductive composition means to said battery pack.

3. In the electrical system of claim 1 or 2 wherein the current operated module is an LED unit, and the LED unit is removably connected to said object.

4. In the electrical system of claim 1 or 2 wherein the conductive composition means is colored.

5. In the electrical system as claimed in claims 1 or 2 wherein the conductive composition means has a relatively high conductivity and low resistivity to transmit relatively low electrical current at the required voltage.

6. In the electrical system of claims 1 or 2 wherein the conductive composition means is colored, and said conductive composition means has a relatively high conductivity and low resistivity to provide relatively low electrical current at the required voltage.

7. In the electrical system of claims 1 or 2 wherein, a. the object has a portion thereof forming a panel, b. said conductive composition means is affixed to said panel, and c. the current operated module is removably connected in assembled position to said panel and communicates with said conductive composition means.

8. In the electrical system as claimed in claim 7 wherein the conductive composition means is colored.

9. In the electrical system as claimed in claim 7 wherein the conductive composition means has a relatively high conductivity and low resistivity to transmit low electrical current at the required voltage.

10. In the electrical system as claimed in claim 7 wherein the conductive composition means is colored, and said conductive composition means has a relatively high conductivity and low resistivity to provide relatively low electrical current at the required voltage.

11. In the electrical system of claims 1 or 2 wherein, a. the object has a portion thereof forming a panel, b. said conductive composition means is affixed to portions of the exterior of said panel, and c. the current operated module is removably connected in assembled position to said panel and communicates with said conductive composition means.

12. In the electrical system as claimed in claim 11 wherein the conductive composition means is colored.

13. In the electrical system as claimed in claim 11 wherein the conductive composition means has a relatively high conductivity and low resistivity to transmit low electrical current at the required voltage.

14. In the electrical system as claimed in claim 11 wherein the conductive composition means is colored, and said conductive composition means has a relatively high conductivity and low resistivity to provide relatively low electrical current at the required voltage.

15. In the electrical system of claims 1 or 2 wherein, a. the object has a portion thereof forming a panel having a design on the exterior surface thereof, b. said conductive composition means is affixed to portions of the exterior of said panel in operative association with said design, and c. the current operated module is removably connected in assembled position to said panel so as to extend to the exterior thereof and communicates with said conductive composition means on the exterior of said panel.

16. In the electrical system as claimed in claim 15 wherein the conductive composition means is colored.

17. In the electrical system as claimed in claim 15 wherein the conductive composition means has a relatively high conductivity and low resistivity to transmit low electrical current at the required voltage.

18. In the electrical system as claimed in claim 15 wherein the conductive composition means is colored, and said conductive composition means has a relatively high conductivity and low resistivity to provide relatively low electrical current at the required voltage.

19. In the electrical system of claims 1 or 2 wherein the conductive composition means has a high silver content and includes, a plastisol to facilitate the affixation thereof to said object.

20. In the electrical system as claimed in claim 19 wherein the conductive composition means is colored.

21. The electrical system of claim 1 further comprising means for controlling the operation of said at least one current operated module.

22. A light illuminating assembly comprising:

a. at least one LED module including, means for affixing said LED module in a predetermined position on an object having a design thereon, b. battery pack means to provide electrical power for illuminating said at least one LED module, and c. conductive composition means between the at least one LED module and the battery pack means for transmitting current to operate the at least one LED module, said conductive composition means forming at least a portion of said design on said object.

23. In the light illuminating assembly as claimed in claim 22 wherein the conductive composition means is colored.

24. In the light illuminating assembly as claimed in claim 22 wherein the conductive composition means has a relatively high conductivity and low resistivity to transmit low electrical current at the required voltage.

25. In the light illuminating assembly as claimed in claim 22 wherein the conductive composition means is colored, and said conductive composition means has a relatively high conductivity and low resistivity to provide relatively low electrical current at the required voltage.

26. In the light illuminating assembly as claimed in claim 22 including, a. means for removably connecting said battery pack means and b. means on the connecting means for conducting current to the conductive composition means from the battery pack means.

27. In the light illuminating assembly as claimed in claim 26 wherein;

a. the removable connecting means is a "VELCRO" fastener having one side disposed for contact and communication with the conductive composition means, and b. the opposite side of the "VELCRO" fastener is operatively connected to the battery pack means to permit the removal thereof from assembled position.

28. The light illuminating assembly of claim 22 further comprising means for controlling the operation of said at least one current operated module.

29. The combination of an electrical system and objects having a design thereon formed at least partially by said electrical system, including, a. at least one current operated module with means for affixing said at least one current operated module in a predetermined position on at least one of the objects, b. battery pack means to provide electrical power for illuminating said at least one current operated module, and c. conductive composition means formed on said objects so when said objects are interconnected communication between the at least one current operated module and the battery pack means is established for transmitting current to operate the at least one current operated module, said conductive composition means forming at least a portion of said design on said objects.

30. In the combination as claimed in claim 29 wherein the conductive composition means is colored.

31. In the combination as claimed in claim 29 wherein the conductive composition means has a relatively high conductivity and low resistivity to transmit low electrical current at the required voltage.

32. In the combination as claimed in claim 29 wherein the conductive composition means is colored, and said conductive composition means has a relatively high conductivity and low resistivity to provide relatively low electrical current at the required voltage.

33. In the combination as claimed in claim 29 including, means for removably connecting said battery pack means to said conductive composition means and means on the connecting means for conducting current to the conductive composition means from the battery pack means.

34. The combination of claim 29 further comprising means for controlling the operation of said at least one current operated module.

35. The combination of an electrical system with a jigsaw puzzle having a plurality of interconnecting pieces, said electrical system forming a design on said jigsaw puzzle, including, a. at least one LED module with means for affixing said LED module in a predetermined position on at least one of the interconnecting pieces of said jigsaw puzzle, b. battery pack means to provide electrical power for illuminating said at least one LED module, and c. conductive composition means affixed on said interconnecting pieces of said jigsaw puzzle so when they are interconnected to form the jigsaw puzzle communication between the at least one LED module and the battery pack means is established for transmitting current to operate the at least one LED module, said conductive composition means forming at least a portion of said design on said jigsaw puzzle.

36. In the combination as claimed in claim 35 wherein the conductive composition means is colored.

37. In the combination as claimed in claim 35 wherein the conductive composition means has a relatively high conductivity and low resistivity to transmit low electrical current at the required voltage.

38. In the combination as claimed in claim 35 wherein the conductive composition means is colored, and said conductive composition means has a relatively high conductivity and low resistivity to provide relatively low electrical current at the required voltage.

39. In the combination as claimed in claim 35 including, means for removably connecting said battery pack means to said conductive composition means and means on the connecting means for conducting current to the conductive composition means from the battery pack means.

40. The combination of claim 35 further comprising means for controlling the operation of said at least one current operated module.

41. The combination of an electrical system with toy blocks having a plurality of interconnecting pieces, said electrical system forming a design on said jigsaw puzzle, including, a. at least one LED module with means for affixing said LED module in a predetermined position on at least one or more of the interconnecting pieces of said toy blocks, b. battery pack means to provide electrical power for illuminating said at least one LED module, and c. conductive composition means formed on said interconnecting pieces of the toy blocks so when they are interconnected, communication between the at least one LED module and the battery pack means is established for transmitting current to operate the at least one LED module, said conductive composition means forming at least a portion of said design on said jigsaw puzzle.

42. In the combination as claimed in claim 41 wherein the conductive composition means is colored.

43. In the combination as claimed in claim 41 wherein the conductive composition means has a relatively high conductivity and low resistivity to transmit low electrical current at the required voltage.

44. In the combination as claimed in claim 41 wherein the conductive composition means is colored, and said conductive composition means has a relatively high conductivity and low resistivity to provide relatively low electrical current at the required voltage.

45. In the combination as claimed in claim 41 including, means for removably connecting said battery pack means to said conductive composition means including, means on the connecting means for conducting current and signals to the conductive composition means from the battery pack means.

46. The combination of claim 41 further comprising means for controlling the operation of said at least one current operated module.

47. An electrical system for use on an object, said electrical system comprising, at least one current operated module having means for affixing the module in a predetermined position on said object, battery pack means to provide the current for operating said at least one current operated module, and conductive composition means connecting said battery pack means to said at least one current operated module for delivering current to said current operated module, said conductive composition means being colored wherein the coloring is a substantially nonconductive portion of said conductive composition.

48. The electrical system of claim 47 including, means for detachably connecting said conductive composition means to said battery pack means.

49. The electrical system of claim 47 wherein the current operated module is an LED unit, and the LED unit is removably connected to said object.

50. The electrical system of claim 47 wherein the conductive composition means has a relatively high conductivity and low resistivity to transmit relatively low electrical current at the required voltage.

51. The electrical system of claim 47 wherein, a. the object has a portion thereof forming a panel, b. said conductive composition means is affixed to said panel, and c. the current operated module is removably connected in assembled position to said panel and communicates with said conductive composition means.

52. The electrical system of claim 47 wherein the conductive composition means has a high silver content and includes, a plastisol to facilitate the affixation thereof to said object.

53. The electrical system of claim 47 further comprising means for controlling and signalling the operation of said at least one current operated module.

54. A light illuminating assembly comprising:

a. at least one LED module including, means for affixing said LED module in a predetermined position on an object, b. battery pack means to provide electrical power for illuminating said at least one LED module, and c. conductive composition means between the at least one LED module and the battery pack means for transmitting current to the at least one LED module, said conductive composition means being colored wherein the coloring is a substantially nonconductive portion of said conductive composition.

55. The light illuminating assembly of claim 54 wherein the conductive composition means has a relatively high conductivity and low resistivity to transmit low electrical current at the required voltage.

56. The light illuminating assembly of claim 54 including, a. means for removably connecting said battery pack means to said conductive composition means, and b. means on the connecting means for conducting current to the conductive composition means from the battery pack means.

57. The light illuminating assembly of claim 56 wherein;

a. the removable connecting means is a "VELCRO" fastener having one side disposed for contact and communication with the conductive composition means, and b. the opposite side of the "VELCRO" fastener is operatively connected to the battery pack means to permit the removal thereof from assembled position.

58. The light illuminating assembly of claim 54 further comprising means for controlling the operation of said at least one current operated module.

59. The combination of an electrical system and objects, including, a. at least one current operated module with means for affixing said at least one current operated module in a predetermined position on at least one of the objects, b. battery pack means to provide electrical power for illuminating said at least one current operated module, and c. conductive composition means formed on said objects so when said objects are interconnected communication between the at least one current operated module and the battery pack means is established for transmitting current to the at least one current operated module, said conductive composition means being colored wherein the coloring is a substantially nonconductive portion of said conductive composition.

60. The combination of claim 59 wherein the conductive composition means has a relatively high conductivity and low resistivity to transmit low electrical current at the required voltage.

61. The combination of claim 59 including, means for removably connecting said battery pack means and the control means to said conductive composition means and means on the connecting means for conducting current to the conductive composition means from the battery pack means and the control means.

62. The combination of claim 59 further comprising means for controlling the operation of said at least one current operated module.

63. The combination of an electrical system with a jigsaw puzzle having a plurality of interconnecting pieces, including, a. at least one LED module with means for affixing said LED module in a predetermined position on at least one of the interconnecting pieces of said jigsaw puzzle, b. battery pack means to provide electrical power for illuminating said at least one LED module, and c. conductive composition means affixed on said interconnecting pieces of said jigsaw puzzle so when they are interconnected to form the jigsaw puzzle communication between the at least one LED module, the battery pack means is established for transmitting current to the at least one LED module, said conductive composition means being colored wherein the coloring is a substantially nonconductive portion of said conductive composition.

64. The combination of claim 63 wherein the conductive composition means has a relatively high conductivity and low resistivity to transmit low electrical current at the required voltage.

65. The combination of claim 63 including, means for removably connecting said battery pack means to said conductive composition means and means on the connecting means for conducting current to the conductive composition means from the battery pack means.

66. The combination of claim 63 further comprising means for controlling the operation of said at least one current operated module.

67. The combination of an electrical system with toy blocks having a plurality of interconnecting pieces, including, a. at least one LED module with means for affixing said LED module in a predetermined position on at least one or more of the interconnecting pieces of said toy blocks, b. battery pack means to provide electrical power for illuminating said at least one LED module, and c. conductive composition means formed on said interconnecting pieces of the toy blocks so when they are interconnected, communication between the at least one LED module and the battery pack means is established for transmitting current to the at least one LED module, said conductive composition means being colored wherein the coloring is a substantially nonconductive portion of said conductive composition.

68. The combination of claim 67 wherein the conductive composition means has a relatively high conductivity and low resistivity to transmit low electrical current at the required voltage.

69. The combination of claim 67 including, means for removably connecting said battery pack means to said conductive composition means and means on the connecting means for conducting current to the conductive composition means from the battery pack means.

70. The combination of claim 67 further comprising means for controlling and signalling the operation of said at least one current operated module.

71. An electrical system for use on an object, said electrical system comprising, at least one current operated module having means for affixing the module in a predetermined position on said object, battery pack means to provide current for operating said at least one current operated module, and conductive composition means connecting said battery pack means to said at least one current operated module for delivering current to said current operated module, said conductive composition means being washable so that it will continue to permit proper operation of the electrical system after being exposed to multiple washes.

72. The electrical system of claim 71 including, means for detachably connecting said conductive composition means to said battery pack.

73. The electrical system of claim 71 wherein the current operated module is an LED unit, and the LED unit is removably connected to said object.

74. The electrical system of claim 71 wherein the conductive composition means is colored.

75. The electrical system of claim 71 wherein the conductive composition means has a relatively high conductivity and low resistivity to transmit relatively low electrical current at the required voltage.

76. The electrical system of claim 71 wherein, a. the object has a portion thereof forming a panel, b. said conductive composition means is affixed to said panel, and c. the current operated module is removably connected in assembled position to said panel and communicates with said conductive composition means.

77. The electrical system of claim 71 wherein, a. the object has a portion thereof forming a panel having a design on the exterior surface thereof, b. said conductive composition means is affixed to portions of the exterior of said panel in operative association with said design, and c. the current operated module is removably connected in assembled position to said panel so as to extend to the exterior thereof and communicates with said conductive composition means on the exterior of said panel.

78. The electrical system of claim 71 wherein the conductive composition means has a high silver content and includes, a plastisol to facilitate the affixation thereof to said object.

79. The electrical system of claim 71 wherein said object is made of fabric.

80. The electrical system of claim 71 further comprising means for controlling the operation of said at least one current operated module.

81. A light illuminating assembly comprising:

a. at least one LED module including, means for affixing said LED module in a predetermined position on an object, b. battery pack means to provide electrical power for illuminating said at least one LED module, and c. conductive composition means between the at least one LED module and the battery pack means for transmitting current to the at least one LED module, said conductive composition means being washable so that it will continue to permit proper operation of the electrical system after being exposed to multiple washes.

82. In the light illuminating assembly of claim 81 wherein the conductive composition means is colored.

83. In the light illuminating assembly of claim 81 wherein the conductive composition means has a relatively high conductivity and low resistivity to transmit low electrical current at the required voltage.

84. In the light illuminating assembly of claim 81 including, a. means for removably connecting said battery pack means, and b. means on the connecting means for conducting current to the conductive composition means from the battery pack means.

85. In the light illuminating assembly of claim 84 wherein;

a. the removable connecting means is a "VELCRO" fastener having one side disposed for contact and communication with the conductive composition means, and b. the opposite side of the "VELCRO" fastener is operatively connected to the battery pack means to permit the removal thereof from assembled position.

86. The light illuminating assembly of claim 81 wherein said object on which said light illuminating assembly is attached is made of fabric.

87. The light illuminating assembly of claim 81 further comprising means for controlling the operation of said at least one current operated module.

* * * * *